US005195620A

United States Patent [19]

Tate

[11] Patent Number: 5,195,620

[45] Date of Patent: Mar. 23, 1993

[54] WRINKLE-REDUCING INSERT FOR SUITCASES AND THE LIKE

[76] Inventor: Patty L. Tate, 22 Marlwood La., Palm Beach Gardens, Fla. 33418

[21] Appl. No.: 797,205

[22] Filed: Nov. 25, 1991

[51] Int. Cl.[5] ..... A45C 13/02

[52] U.S. Cl. ..... 190/36; 190/110; 206/292

[58] Field of Search ..... 190/36, 110; 206/292; 220/529

[56] References Cited

U.S. PATENT DOCUMENTS

| | | | |
|---|---|---|---|
| 401,439 | 4/1889 | Karo | 190/36 |
| 524,163 | 8/1894 | Coleman | 190/36 |
| 556,526 | 3/1896 | Baker | 190/36 |
| 1,847,066 | 3/1932 | Berg | 206/292 |
| 2,222,160 | 11/1940 | Walsh | 220/529 |
| 3,125,198 | 3/1964 | Stark | 190/110 |
| 3,330,388 | 7/1967 | Stein | 190/110 |
| 4,580,667 | 4/1986 | Herwood | 190/110 |
| 4,718,524 | 1/1988 | Crumley | 190/110 |
| 4,793,508 | 12/1988 | Thompson | 190/110 |
| 4,852,293 | 8/1989 | Levine et al. | 190/110 |

FOREIGN PATENT DOCUMENTS 23728 of 1900 United Kingdom ..... 206/292

*Primary Examiner*—Gary E. Elkins

*Attorney, Agent, or Firm*—Harness, Dickey & Pierce

[57] ABSTRACT

A wrinkle-reducing insert for suitcases and the like containers within which folded, wrinkleable, cloth-like garments and the like items are packed for travel purposes, comprises a stack of substantially identical, thin, smooth, plastic sheets which are flexible, but generally stiff enough to avoid crumpling or wrinkling. The stack of sheets is held together as a unit by a cord-like or rod-like connector loosely fitted through adjacent aligned holes formed in the sheets so that the sheets may be freely separated apart from each other. The sheets are sized to closely fit within the walls defining the container for limiting transverse movement of the sheets within the container. Folded cloth-like items are packed, layer-by-layer, between adjacent pairs of sheets for substantially filling the container, so that the container may be transported and stored during travel and the packed items will substantially resist wrinkling while packed in the container.

10 Claims, 1 Drawing Sheet

WRINKLE-REDUCING INSERT FOR SUITCASES AND THE LIKE

BACKGROUND OF THE INVENTION

This invention relates to the provision of an insert for conventional suitcases, hanging bags and the like travel containers, which reduces wrinkling of the garments and other cloth-like items packed within such containers.

Ordinarily, folded garments and other cloth-like items packed within travel suitcases and similar travel containers, wrinkle more or less depending on the nature of the item, the volume that it is compacted within the container and other factors such as humidity, length of time that the items remained packed etc. Because of the common problem of wrinkling of garments during transportation or storage of travel containers, various methods have been adopted to reduce wrinkling. Different suitcase and hanging bag designs have been utilized for the purpose of limiting wrinkling. Nevertheless, wrinkling still remains a common problem.

Wrinkling particularly occurs in the large open suitcase-type of containers in which there may be a single cavity within which folded garments are placed. To a considerable extent, such wrinkling also occures in hanging bags, even though the garments may be hung individually on hangers within a foldable bag.

It seems that such wrinkling occurs because of the compacting of the garments within the bag and because of the shifting of the garments relative to each other when the bags are moved about.

Consequently, there has been a need for some relatively inexpensive means for reducing the wrinkling of garments packed within suitcases and other similar travel containers.

SUMMARY OF INVENTION

This invention relates to an insert for positioning within a single-cavity suitcase or travel container or within similar hanging-bags or the like types of containers within which garments and other cloth-like articles may be packed for travel and storage purposes. The insert contemplated by this invention comprises a stack of sheets of thin, plastic material of a type which is sufficiently stiff to be flexible and bendable, but tending to avoid wrinkling or bunching or crumpling of the sheet under surface pressure. Each of the sheets forming the stack is sized to fit within a particular container within the insert will be used. The sheets are the same size. Thus, the inserts, as a group and the sheets individually are restricted against laterally moving, i.e., against movement within their respective planes, by contact with the opposite side wall portions of the container.

The sheets may be loosely connected together, such as by a loop extending through aligned openings formed in the sheets, so that the stack may be handled as a unit for insertion or removal from the container. However, the connecting means is sufficiently loose so that the sheets may be separated, one from another, sufficient distances to accommodate the positioning of cloth-like articles therebetween.

In use, folded garments and the like cloth-like articles are positioned between each adjacent pair of sheets which separate sufficiently for that purpose. With the sheets positioned within a suitcase-like container, the sheets and garments folded there between form layers which fill the container cavity. After the suitcase-like container is packed and closed, the container may be moved or stored, in the course of travel, in the normal manner. However, the contents will resist wrinkling, because of the inserts, so that upon unpacking the container, the cloth-like articles within will be substantially wrinkle-free as contrasted with ordinary packing of similar containers.

An object of this invention is to provide a simple, inexpensive, insert which may be made to fit particular sized and shaped travel containers, such as suitcases, hanging bags and the like containers, which will permit layering of the packed cloth-like articles and holding of such articles between adjacent sheets of relatively stiff plastic sheets to resist movement of the articles and therefore reduce wrinkling thereof during normal transportation and storage of the containers.

Another object of this invention is to provide inexpensive layers formed of smooth-surfaced sheets of plastic which snugly fit within a suitcase and the like travel containers, for packing, in a layered arrangement, cloth-like articles between each adjacent pair of sheets so as to reduce wrinkling of the articles during use of the container for travel or storage purposes.

Yet another object of this invention is to provide an inexpensive insert which may be separately purchased by the owner of a suitcase or similar travel container, for fitting within such container to enable packing cloth-like articles in a layered arrangement between sheets of stiff, smooth plastic sheet material which reduces wrinkling of the articles.

These and other objects and advantages of this invention will become apparent upon reading the following description of which the attached drawings form a part.

DETAILED DESCRIPTION

Figure 1:
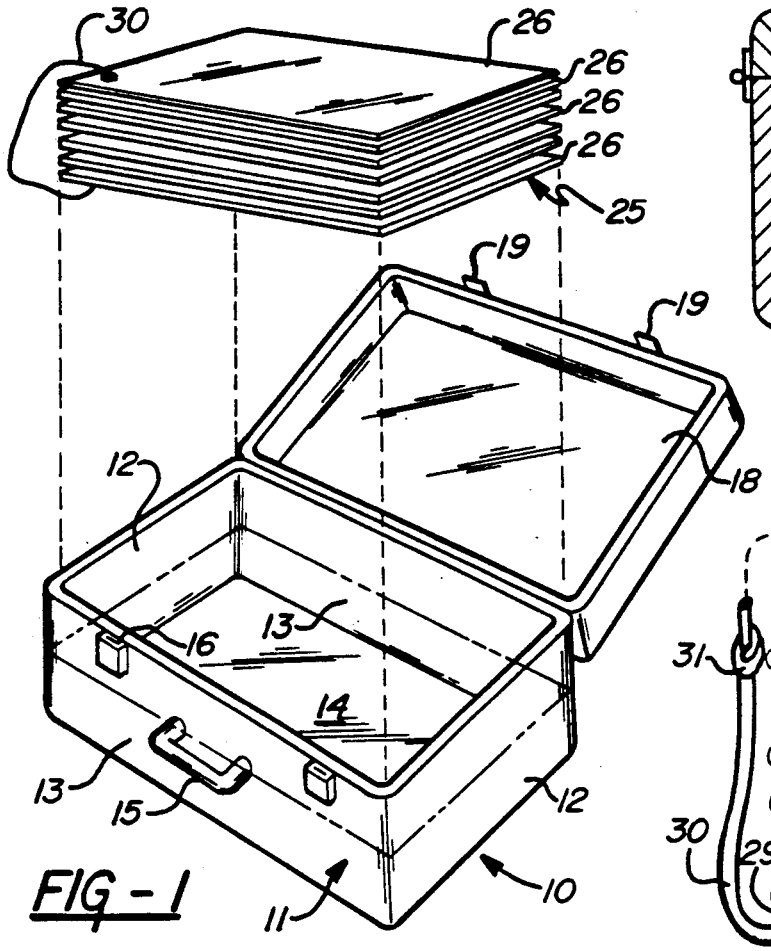
FIG. 1 is a perspective view of a conventional suitcase with an insert arranged above the open suitcase for insertion therein, and schematically showing one of the insert, in dotted lines, positioned within the container.

FIG. 1 illustrates a perspective view of a conventional suitcase 10 which is shown schematically. The suitcase comprises a container 11 formed with opposing end walls 12, sidewalls 13, and a bottom 14 which define the cavity within which articles may be packed. As is typical, a handle 15 is attached to the container and fasteners 16 are applied upon the container. The suitcase includes a conventional cover 18, formed as a shallow tray, which is hingedly connected to the main container body. Conventional fastener halves 19 are attached to the cover for engagement with the fastener halves 16 for closing the suitcase.

Suitcases may vary in construction, size and shape. Thus, the suitcase described above is illustrative of a typical suitcase which may be varied in size and construction. It also typifies the hanging-bag type of suitcase which generally comprises an elongated flat, relatively flexible container within which clothing may be packed on hangers and which may be folded in half for carrying purposes. The particular type or size or style of the suitcase or the hanging bag or the like travel container is not material to this invention.

FIG. 1 illustrates an insert 25 which is formed of a stack of layers 26. These layers are made of sheets of a plastic material which are relatively thick, such as the thickness of stiff construction paper. The thickness and the nature of the plastic may vary considerably. However, the sheets should be characterized by being bendable or flexible, but, nevertheless, sufficiently stiff so as to resist crumpling, wrinkling or bunching under surface pressure. That is, the sheets should retain a generally flat, or planar configuration during normal use. There are many types of plastic materials available for use for this purpose. The selection of the particular plastic will be dependent upon the availability, cost, etc.

The layers or sheets 26 are of the same size and shape within the stack. However, the sheets are cut too closely or fitted too snugly within a particular container, within which the insert will be used, so that once positioned within the container, as illustrated by the dotted lines in FIG. 1, they will not shift or move laterally, i.e., within the plane of the sheet.

The sheets are preferably loosely connected together so that the inserts may be handled as a unit. Connecting means, therefore, are provided for securing the sheets together.

Figure 3:
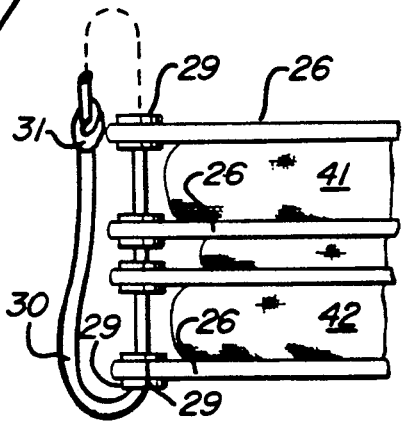
FIG. 3 is a further enlarged, fragmentary view, of a number of the layers or sheets forming the insert with folded, cloth-like articles arranged between adjacent pairs of such sheets.
Figure 4:
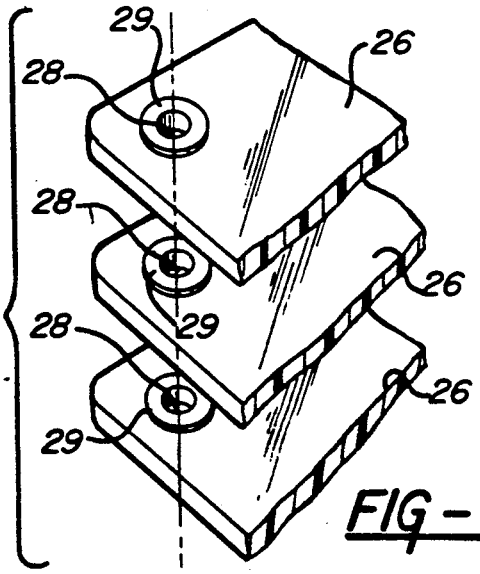
FIG. 4 is an enlarged, fragmentary perspective view illustrating aligned openings formed in the sheets for securing them together.

The drawings illustrate holes 28 formed near the corners of each of the sheets, with the holes being vertically aligned, as shown in FIG. 4. The holes may be reinforced by grommets 29 of the conventional type or ring-like reinforcements formed by heating and pressing the areas around the holes to form integral grommet-like configurations. A fastener cord 30 may be passed through the holes 28, as shown in FIG. 3, for keeping the sheets together as a unit. The string or cord is of a sufficient length to form a loose loop which permits substantial separation between the sheets. For this purpose, a loose, lengthy cord may be used with the ends of the cord tied together by a knot 31.

Figure 5:
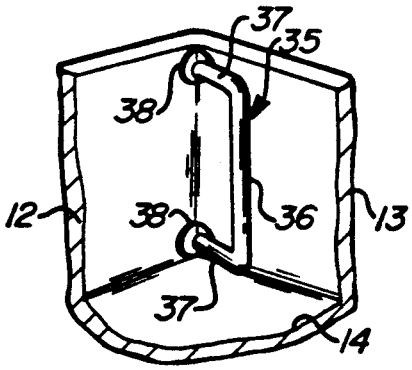
FIG. 5 is a fragmentary, perspective view, of a corner of a suitcase having a bracket mounted therein for securing a multi-sheet insert within the suitcase.

As an alternative, as illustrated in FIG. 5, the fastening means may be formed as a U-shaped bracket 35 made of a stiff material such as of a metal rod. The base 36 which may be inserted through the holes 28 in the sheets. The legs 37 of the bracket are secured permanently to the container by suitable fastening brackets 38. However, the fastening brackets 38 may be of a type which permit the rod 35 to be pulled free of the fastening brackets for permitting removal of the insert from the container.

Figure 2:
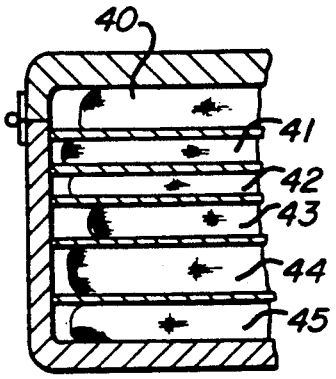
FIG. 2 is an enlarged, fragmentary cross-sectional view of a portion of the suitcase, with its lid closed and with cloth-like articles packed in layers within the insert.

In operation, the insert stack is placed within the container, one layer at a time. Folded garments or other cloth-like articles generally designated as 40, 41, 42, 43, 44 and 45 (see FIG. 2) are positioned in layers between each adjacent pair of sheets. The sheets pairs of sheets are separated apart sufficiently to accommodate the particular article arranged therebetween. After the articles are packed within the insert, the suitcase cover may be closed and fastened in place. Thereafter, the suitcase may be transported and stored in the conventional manner during travel. It has been found that with this packing arrangement, when the suitcase is opened and the folded cloth-like articles are removed therefrom, they will be substantially wrinkle-free. That is, substantially fewer and less permanent wrinkling occurs as contrasted with normal conventional packing of articles that are simply placed one upon the another within a suitcase.

The sheets forming an insert may be pre-cut to a standard size that is typically larger than a particular group of conventional suitcases. Then, the user may purchase the insert and cut each of the sheets to the exact size of a particular suitcase with which the insert will then be used. In that manner, a limited number of standard sized inserts may be manufactured and sold, with the users finishing the exact sizing required.

This invention may be further developed within the scope of the following claims. Accordingly, it is desired that the foregoing description be read as being merely illustrative of an operative embodiment of this invention and not in a strictly limited sense.

Having fully described and operative embodiment of this invention, I now claim:

1. A wrinkle-reducing insert for suitcases and travel containers used for holding garments and articles for travel purposes, and having container cavities of a depth which is considerably less than the width and height of the container, the cavities defined with side walls, end walls and bottoms to form the containers, and with a top for closing the cavities comprising:

a stack of substantially identical layers of relatively smooth-surfaced, thin, flat plastic sheets which are characterized by being flexible for bending, but somewhat stiff to resist crumpling and wrinkling and to remain substantially planar;

each of said layers being of a size to closely fit within the container cavity with which said stack is to be used, so as to be substantially restricted against transverse movement by engagement with opposing portions of the container walls;

said layers being loosely separable, one from another, but being formed for arrangement in substantial parallelism;

connecting means loosely connecting said layers together at one common location on each layer, so that the layers may be picked-up and handled as a unit, apart from the suitcase or container, for removal from and insertion within the suitcase or container, with the unit formed of loosely interconnected sheets, but wherein the layers may be separated from each other while remaining parallel and are capable of said transverse movement for sufficient distances to receive folded travel items between adjacent pairs of such layers;

whereby folded clothing and travel items may be packed between adjacent layers until the layers and the items packed there between fill the depth of the container, so as to substantially reduce wrinkling of the items when the suitcase or travel container is closed and is transported or stored during travelling use.

2. A construction as defined in claim 1, and said layers being roughly rectangular in shape and being connected together near one corner thereof.

3. A construction as defined in claim 2, and including openings formed near one corner of each layer, with the openings being aligned and including a flexible, cord connector element extending through the openings to form a loop that loosely connects the layers together.

4. A construction as defined in claim 3, and including ring reinforcements surrounding each of such openings and secured to their respective sheets, to form grommet formations for reinforcing the openings.

5. A construction as defined in claim 2, and including an opening formed through each of the layers, with the openings of the stack of layers being aligned; and a rod member extending through aligned openings; and means for fastening the opposite ends of the member to an adjacent portion of the container within which the layers are placed.

6. A construction as defined in claim 5, and said member being generally U-shaped with the base of the "U" extending through the openings and having means for connecting free-ends of the legs to the adjacent portions of the container.

7. In a travel container, such as a suitcase, hanging bag and means for transporting folded clothing and other items, with the container having a flat, open cavity within which such items may be packed, a wrinkle-reducing insert positioned within the container and comprising:

a stack of substantially identical sheets formed of a smooth-surfaced, thin plastic material characterized by being flexible and sufficiently stiff to resist crumbling and wrinkling and remaining generally planar;

each of said sheets being of a size to closely fit within a container within which said stack is to be used and to be substantially restricted against lateral movement within the container by contacting against adjacent portions of walls forming the container;

the sheets forming a loosely joined stack wherein the sheets are separable for spacing them apart, one from another, in alignment within the container;

whereby folded clothing and items may be packed between adjacent sheets, with the sheets separating a sufficient distance for such purpose, and with the sheets and packed items there between substantially filling the container, so that when packed within the container, wrinkling of the items during transportation or storage of the packed container will be substantially reduced;

said sheets being loosely interconnected to form a single unit, by connection means which permit the sheets to separate such distances as necessary to accommodate a folded item there between each pair of sheets, but to retain the sheets together while remaining substantially parallel to one another in said stack and are capable of said lateral movement.

8. A construction as defined in claim 7, and with such connecting means comprising a thin member, threaded through aligned openings formed in the sheets near aligned edges thereof for loosely connecting the sheets together.

9. A construction as defined in claim 7, and including said member being formed of a cord element forming a loop extending through the aligned openings in the sheets.

10. A construction as defined in claim 7, and including said connection means being formed of a rigid rod and means connecting said rod within the container.

* * * * *